US011046511B1

(12) United States Patent
Cohen

(10) Patent No.: US 11,046,511 B1
(45) Date of Patent: Jun. 29, 2021

(54) TRASH CAN LID FASTENER

(71) Applicant: Stephen Cohen, Delray Beach, FL (US)

(72) Inventor: Stephen Cohen, Delray Beach, FL (US)

( * ) Notice: Subject to any disclaimer, the term of this patent is extended or adjusted under 35 U.S.C. 154(b) by 0 days.

(21) Appl. No.: 16/448,184

(22) Filed: Jun. 21, 2019

Related U.S. Application Data

(60) Provisional application No. 62/690,033, filed on Jun. 26, 2018.

(51) Int. Cl.
*B65D 55/16* (2006.01)
*B65F 1/16* (2006.01)
*B65D 43/22* (2006.01)

(52) U.S. Cl.
CPC ..... *B65F 1/1615* (2013.01); *B65D 43/22* (2013.01); *B65F 2210/148* (2013.01)

(58) Field of Classification Search
CPC .... B65F 1/1615; B65F 2210/148; B65F 1/16; B65D 43/22; B65D 55/16; A44B 11/02; Y10S 220/908
USPC ..... 220/375, 318, 315, 908
See application file for complete search history.

(56) References Cited

U.S. PATENT DOCUMENTS 2,539,997 A 1/1951 Graves
2,636,639 A 4/1953 Frey
2,687,318 A 8/1954 Cooper
2,809,008 A 10/1957 Halvarson
2,998,276 A 8/1961 Shettler
3,291,515 A 12/1966 Lierman
3,363,924 A 1/1968 Remig
3,503,535 A 3/1970 Sparks, Sr.
3,589,760 A 6/1971 Williams
3,893,725 A 7/1975 Coulter et al.
3,980,202 A * 9/1976 Monyak ..... B65D 45/00 220/318
4,009,897 A 3/1977 Spellman
4,339,056 A 7/1982 Berkstresser, Jr. et al.
4,520,945 A 6/1985 Hodge
4,545,501 A 10/1985 DeFord
4,976,371 A 12/1990 Wise et al.
5,078,295 A 1/1992 Grant
5,150,816 A * 9/1992 DeCastro ..... A47G 19/2272 220/264
5,758,914 A 6/1998 Ioveno
6,880,717 B1 * 4/2005 O'Conor ..... B65F 1/1615 220/315
6,902,081 B2 6/2005 Walker
7,103,944 B2 * 9/2006 Johnson ..... A47J 36/06 220/315
2004/0065666 A1 * 4/2004 Walker ..... B65F 1/1615 220/315
2015/0175352 A1 6/2015 Jacobson

* cited by examiner

*Primary Examiner* — King M Chu
(74) *Attorney, Agent, or Firm* — Christopher Davis-Traina

(57) ABSTRACT

The present invention relates to a device for securing a lid to a container, such as a trash can. This prevents wildlife, such as raccoons, from accessing the contents. The device includes a cord that passes through a hole in the lid. A stopper larger than the hole is attached to the cord and is located inside the lid. The cord is removably connected to a cleat attached to a side wall of the container to secure the lid to the side wall.

17 Claims, 5 Drawing Sheets

TRASH CAN LID FASTENER

CLAIM OF PRIORITY

The present non-provisional patent application claims priority to U.S. Provisional Application No. 62/690,033 filed Jun. 26, 2018, which is incorporated herein by reference in its entirety.

BACKGROUND OF THE INVENTION

Field of the Invention

The invention relates to a device for securing a trash can lid to prevent access to the garbage can's contents by wildlife, among other natural occurrences.

Description of the Related Art

Wildlife, and particularly raccoons, are clever and have learned that trash cans often contain enticing food scraps. Consequently, these animals regularly raid trash cans, in the process strewing trash and generally wreaking havoc.

As a result, many efforts have been made to secure a lid to its container in a way that is easily operable by a person, but prevents access by wildlife. However, many of these solutions are either difficult to install, proprietary to a specific trash can design, or are integrated into the trash can.

Consequently, what is needed is a solution that is easy to install and can be used with a wide variety of types of outdoor trash cans.

SUMMARY OF THE INVENTION

The present invention is directed to a trash can lid lock. The device includes a connector in the form of a cleat that is attached to the outside of a side wall of the trash can. The connector is secured to the side wall by way of a screw passing through a hole in the side wall to engage a connector lock located inside the trash can. The surface opposite the connector lock may be smoothed or rounded to prevent tearing of any trash bag the connector lock may come into contact with.

A cord is attached to the lid of the trash can and runs from the lid to the cleat. When coupled with the cleat, the cord prevents the lid from being opened, particularly by wildlife such as raccoons or other wildlife. When not coupled to the cleat, the lid can be freely opened by a user.

In at least one embodiment, the cord passes through a hole in the trash can lid. A stopper having a larger cross section than the hole is attached to the end of the cord that is inside the container, so as to secure the cord to the lid.

In alternate embodiments, the cord is formed into a loop. This facilitates easier coupling to the cleat, as the cord can be easily looped around the cleat.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Both the foregoing general description and the following detailed description are exemplary and explanatory only and are not restrictive of the invention claimed. As used herein, "or" means "and/or" unless expressly stated otherwise. Furthermore, the use of the singular includes the plural unless specifically stated otherwise, and use of the term "including" as well as other forms, such as "includes," and "included," shall not be considered limiting.

Figure 1:
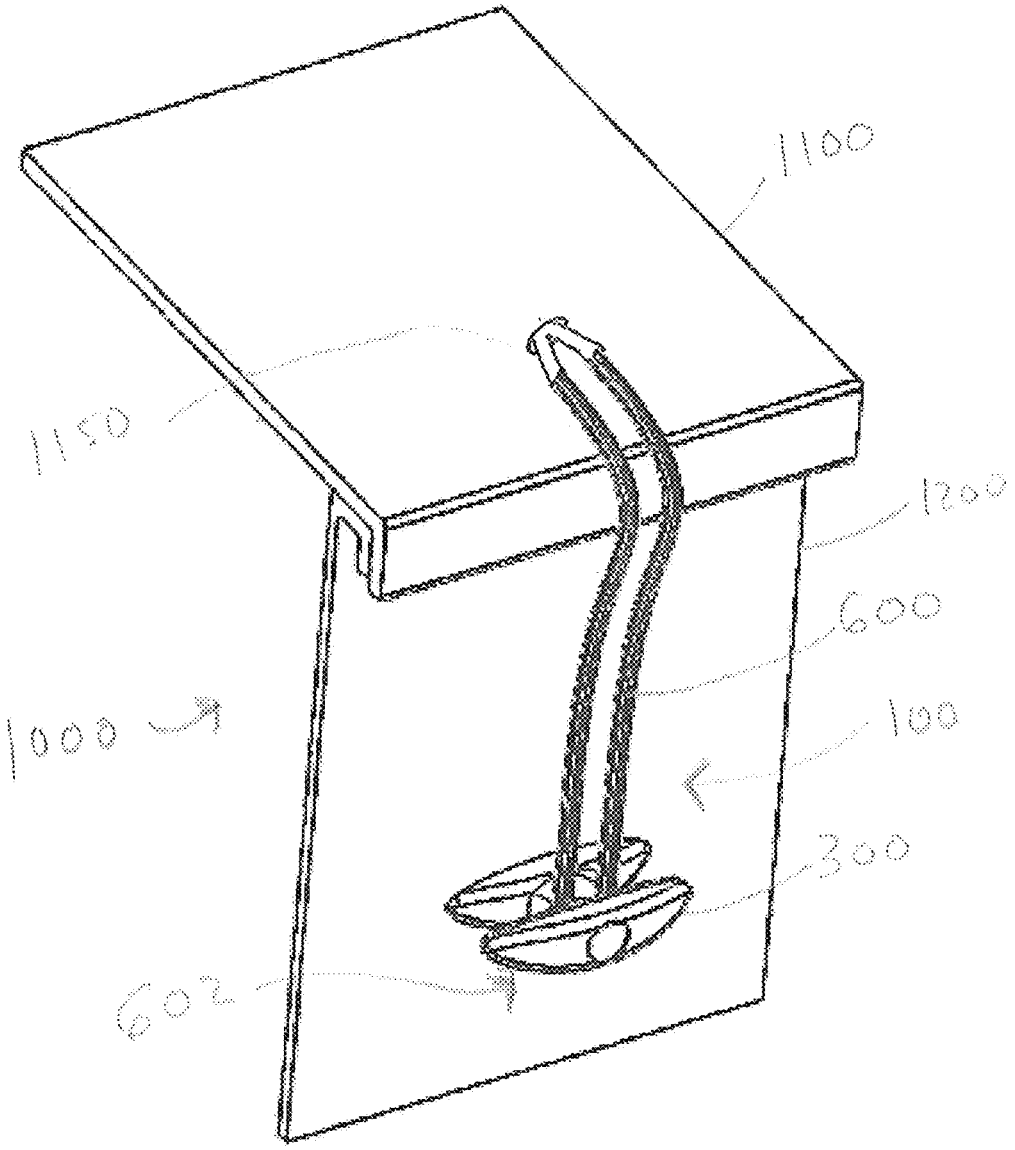
FIG. 1 is a perspective view of a container and device according to an embodiment of the present invention.

With reference to FIG. 1, a cutaway of a container 1000 is shown. The container 1000 is preferably a refuse container, including but not limited to as a trash can or recycling bin. However, any sort of container with a lid may be used.

The container 1000 of FIG. 1 has a side wall 1200 and a lid 1100. The container 1200 has an open top. The lid 1100 covers the open top and engages the side wall 1200 to close the container 1000.

The device 100 facilitates locking the container 1000 by securing the lid 1100 to the side wall 1200. The device 100 includes a cord 600 that is removably coupled to a connector 300. When the cord 600 is coupled to the connector 300, the lid 1100 is restrained to the side wall 1200, placing the container 1000 in the locked position. Uncoupling the cord 600 from the connector 300 allows the lid 1100 to move with respect to the side wall 1200, unlocking the container 1000.

As further described herein, the cord 600 may be formed into a loop. Coupling the cord 600 to the connector 300 includes looping the cord around the connector 300. The cord 600 of FIG. 1 is a loop and passes through a hole 1150 in the lid 1100.

Figure 2:
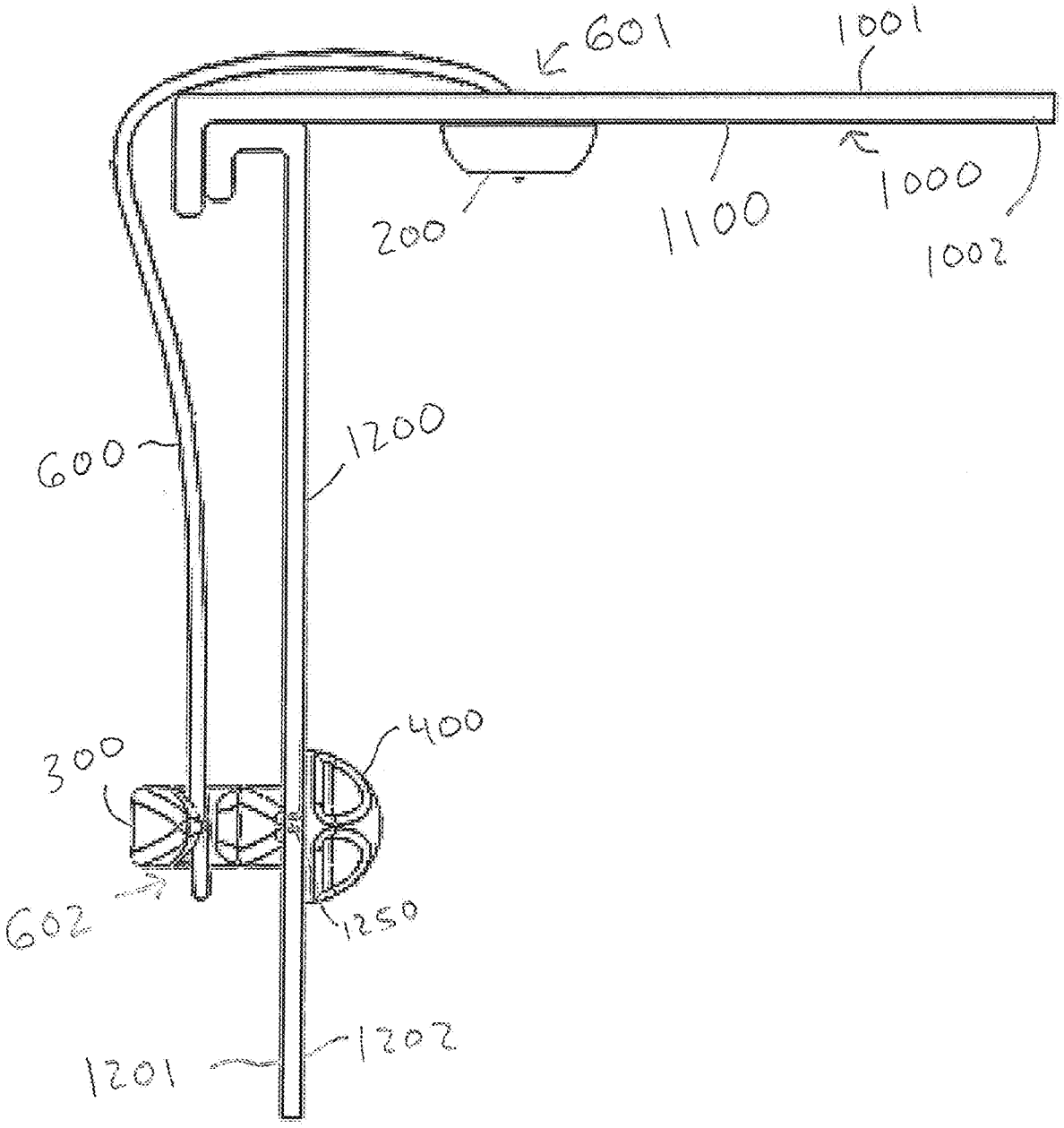
FIG. 2 is a side plan view of a container and device according to an embodiment of the present invention.

As seen in FIG. 2, the lid 1000 has an upper surface 1001 and a lower surface 1002. A stopper 200 attached to the cord 600 is located adjacent the lower surface 1002. The stopper 200 constrains the cord 600 so that it cannot slip through the lid 1000. The cord then 600 runs from the stopper 200, over a portion of the upper surface 1001 of the lid 1000, and adjacent a portion of the sidewall 1200 to the connector 300. The connector 300 is attached to the side wall 1200.

Figure 3:
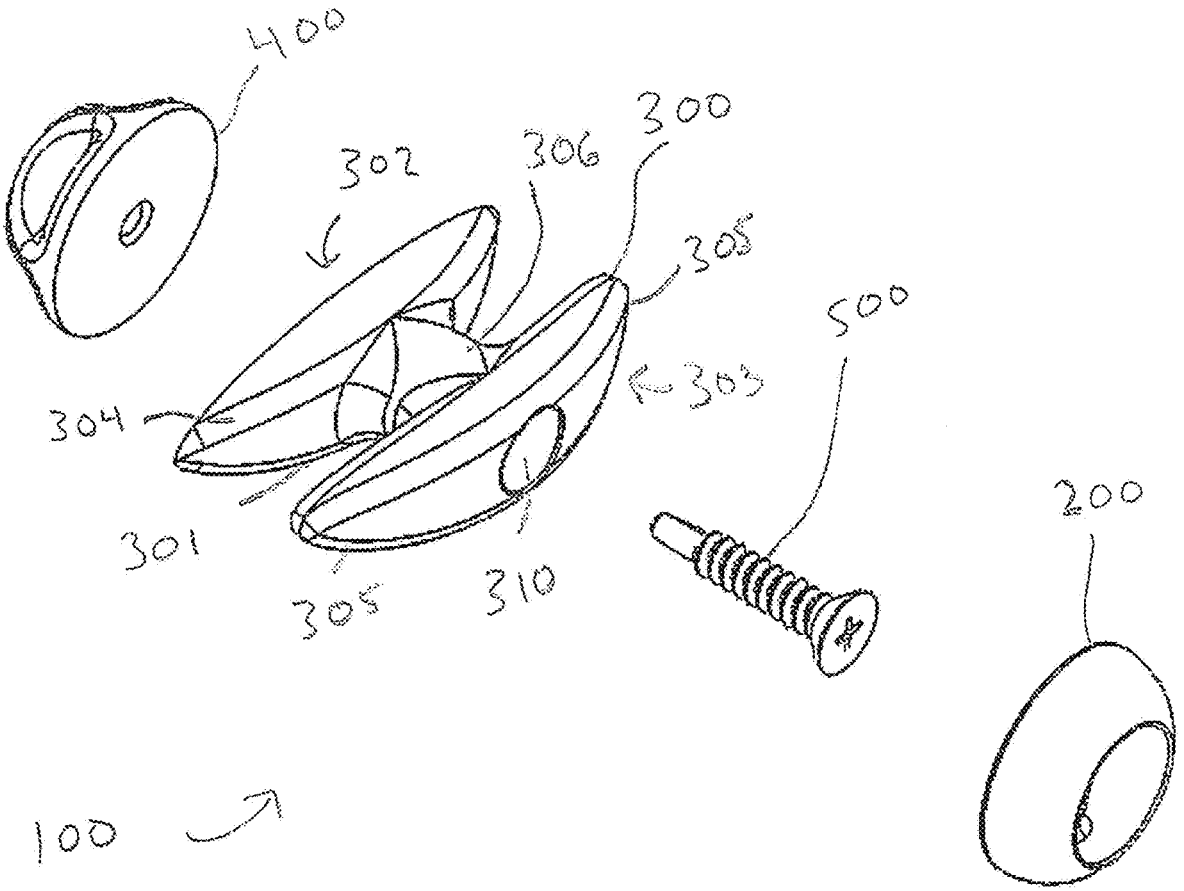
FIG. 3 is a perspective view of a plurality of components according to an embodiment of the present invention.

With reference to FIGS. 2 and 3, the connector 300 is fastened to the side wall with a screw 500. However, any fastener may be used, and it may be threaded or unthreaded. The connector 300 is disposed adjacent an outer surface 1201 of the side wall 1200. A bore 310 passes through the connector 300, which receives and retains the screw 500. The screw 500 passes through a hole 1250 in the sidewall. The screw engages a connector lock 400 adjacent the inner surface 1202 of the side wall 1200.

With further reference to FIGS. 1 and 3, in at least one embodiment the connector 300 comprises a cleat. The connector 300 has a body 301 with opposing ends 302, 303. A first end 302 comprises a base portion 304 that abuts the side wall 1200. The second end 303 comprises a pair of horns 305 that extend laterally in opposite directions. A trunk portion 306 extends between the base 304 and the horns 305. The cord 600 is coupled to the connector 300 by looping the cord 600 around the trunk portion 306.

Figure 4:
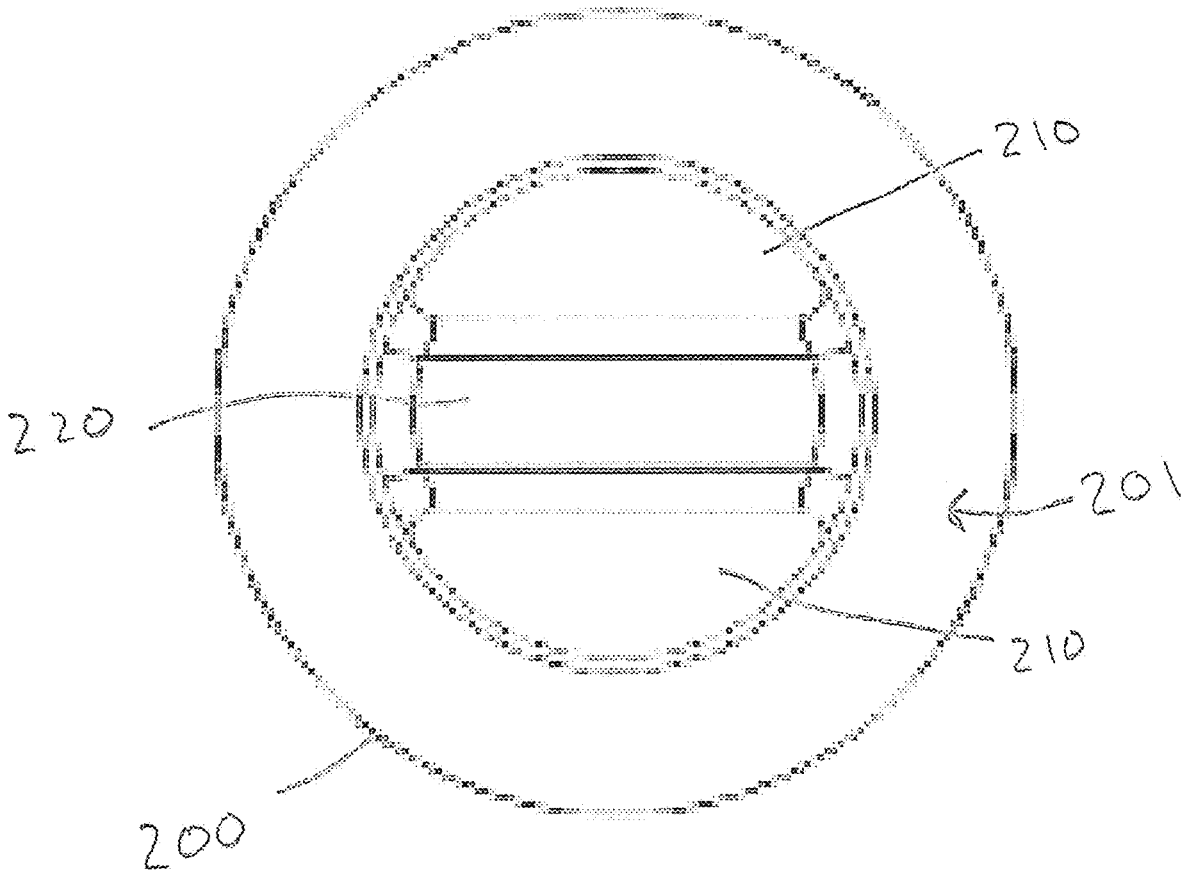
FIG. 4 is a top-down plan view of a stopper according to an embodiment of the present invention.
Figure 5:
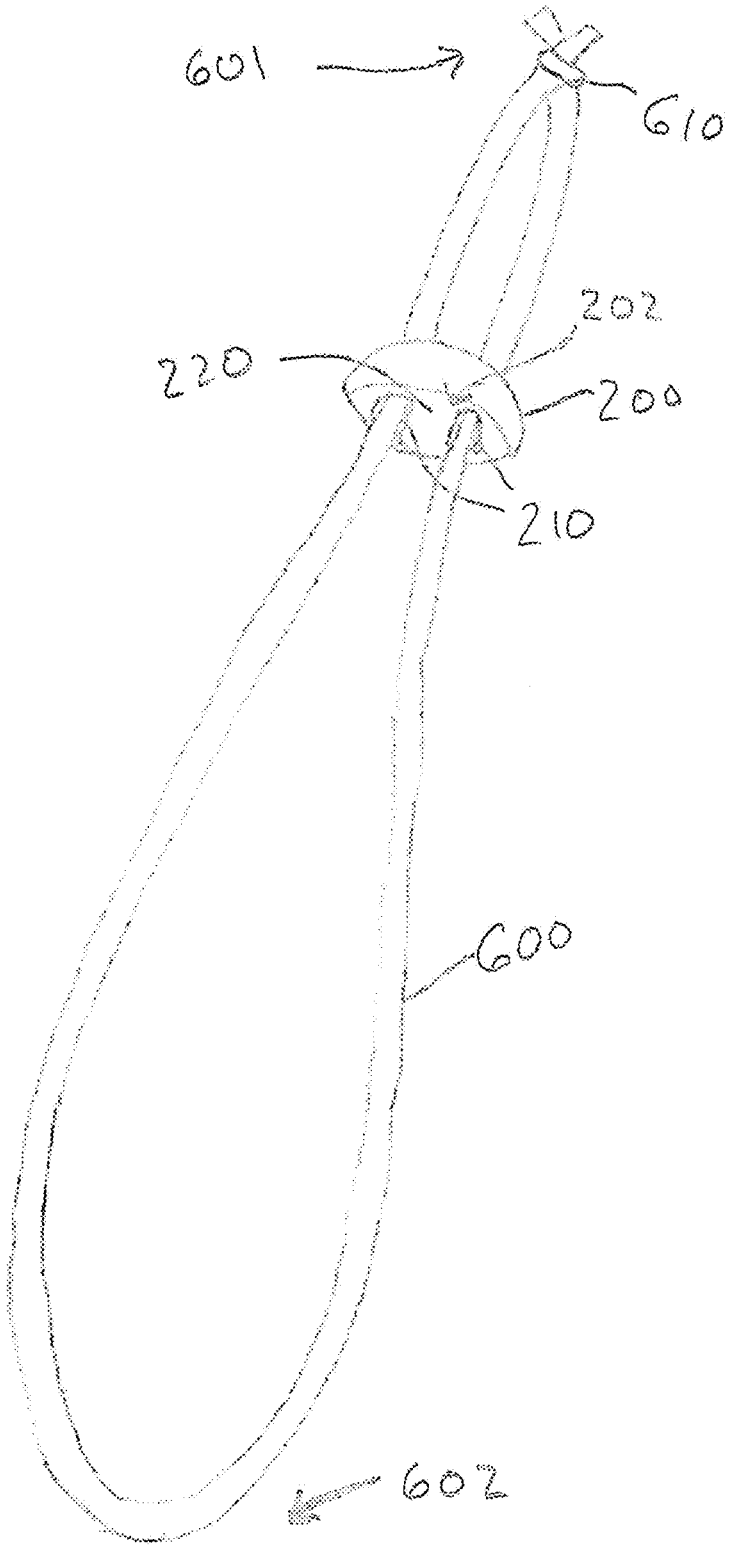
FIG. 5 is a perspective view of a cord and stopper according to an embodiment of the present invention.

With reference to FIGS. 4 and 5, the stopper 200 comprises opposing surfaces 201, 202. A pair of holes 210 pass through the stopper 200 and are separated by a divider 220. The cord 600 passes through the holes 210 and around the divider 220. The stopper 200 is sufficiently dimensioned and configured such that it will not pass through the hole 1150 in the lid 1100 depicted in FIG. 1.

With reference to FIGS. 1 and 5, the cord 600 is formed into a loop. This may be achieved, for example, by way of a crimp 610. A first end of the loop 601 is engaged by the stopper 200 as described above. The second end 602 can be coupled to the connector 300 to lock the container 1000.

With reference to the accompanying figures, any or all of the stopper 200, connector 300, and connector lock 400 may comprise materials such as but not limited to: ABS plastic with a UV additive, ASA plastic, or any combination of the two.

The cord 600 may comprise an elastic material, such as latex rubber. By appropriately distancing the stopper 200 from the connector 300, a cord 600 comprising elastic material may be used to provide tension between the lid 1100 and side wall 1200, making it even more difficult for wildlife to open the container 1000. In various embodiments, the cord 600 may comprise, by way of non-limiting example, materials such as nylon, elastic, polypropylene fabric, or any combination of the foregoing. In embodiments where the cord 600 comprises both an elastic material and a polypropylene fabric, the polypropylene fabric may cover the elastic to shelter it from the elements, including sunlight and sources of abrasion. In at least one embodiment, the cord 600 has a cross sectional diameter of approximately 3/16 inches.

The crimp 610 may comprise ¼ pound 316 stainless steel with a cross sectional diameter of approximately 0.02 inches. 316/316L stainless steel may be used, which aids the manufacturing process whereby the crimp 610 engages the cord 600. In addition, such a material provides excellent corrosion resistance.

The screw 500 may comprise zinc plated steel, which aids against corrosion from moisture. The screw 500 in at least one embodiment is a flat head, stainless steel machine screw measuring ¾ inches or 1 inch.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. A device for removably securing a lid to
a container, the device comprising:
a cord having a first end and a second end,
a stopper coupled to said first end, and
a connector removably coupled to said second end,
wherein said connector comprises a cleat.

2. The device of claim 1, wherein said first and second ends of said cord are coupled so as to form a loop.

3. The device of claim 1, said loop being removably coupled to said cleat when wrapped around said cleat.

4. The device of claim 3, wherein said cord comprises an elastic material of construction.

5. The device of claim 2, wherein said stopper comprises opposing first and second surfaces and a thickness extending therebetween, and a pair of openings each extending through said thickness.

6. The device of claim 5, wherein said openings of said first connector collectively define a divider extending between said openings, and said loop is wrapped around said divider.

7. A device for removably securing a lid to a container, the device comprising:
a stopper having opposing first and second surfaces and a thickness extending therebetween, and a pair of holes extending through said thickness and separated by a divider,
a loop of cord having first and second ends, and said first end is wrapped around said divider,
a connector removably coupled to said loop of cord.

8. The device of claim 7, wherein said connector is a cleat.

9. The device of claim 8, wherein said connector comprises a body having opposing first and second ends, and wherein said first end forms a base, and said second end forms a pair of opposing, laterally extending horns.

10. The device of claim 9, wherein said body of said connector comprises a trunk extending between said first and second ends of said body, and said removable coupling of said loop of cord to said connector comprises wrapping said loop around said trunk.

11. A container assembly comprising:
a container having a side wall and an open top,
a lid being in removable engagement with said side wall,
a connector attached to said side wall,
wherein said connector comprises a cleat,
a stopper disposed adjacent said lid,
a cord coupled to said stopper and removably coupled to said connector.

12. The container assembly of claim 11, said lid comprising opposing upper and lower surfaces and a thickness extending therebetween, and said stopper being disposed adjacent said lower surface.

13. The container assembly of claim 12, said lid comprising at least one hole extending through said thickness, and said cord passing through said hole.

14. The container of claim 11, said side wall comprising opposing inner and outer surfaces, and said connector being disposed adjacent said outer surface.

15. The container of claim 11, said cord being a looped cord.

16. The container of claim 11, said cord comprising an elastic material of construction.

17. The container of claim 11, said container comprising locked and unlocked states, wherein said container is in said locked state when said cord is coupled to said connector, and said container is in said unlocked state when said cord is not coupled to said connector.

* * * * *